United States Patent [19]

Johnston

[11] 4,407,364

[45] Oct. 4, 1983

[54] LANDING NIPPLE FOR PUMPDOWN WELL COMPLETION SYSTEM

[75] Inventor: Russell A. Johnston, Lewisville, Tex.

[73] Assignees: Otis Engineering Corporation, Dallas, Tex.

[21] Appl. No.: 228,996

[22] Filed: Jan. 27, 1981

[51] Int. Cl.[3] ..... E21B 23/10

[52] U.S. Cl. ..... 166/217; 166/237; 166/383; 166/155; 166/156

[58] Field of Search ..... 166/156, 77, 383, 155, 166/117.5, 237, 217; 285/133 A, 133 R, 39, 18, 307

[56] References Cited

U.S. PATENT DOCUMENTS

| | | | |
|---|---|---|---|
| 3,037,797 | 6/1962 | Brown | 285/18 |
| 3,727,693 | 4/1973 | Tansch et al. | 166/156 |
| 4,296,808 | 10/1981 | Baker | 285/133 A |

*Primary Examiner*—William F. Pate, III
*Attorney, Agent, or Firm*—H. Mathews Garland; H. Mathews Garland

[57] ABSTRACT

A pumpdown well completion system for pumpdown well servicing of remotely located wells such as subsea wells including particularly a parking tool and a parking tool landing nipple for a pumpdown flowline to permit pumping a tool train to the landing nipple using a large size piston unit and thereafter pumping a section of the tool train beyond the landing nipple using small size piston units. The parking tool includes a central mandrel having a coupling collet telescopically engaged in a housing having a parking collet. The mandrel is telescopically engaged in the housing for movement between a first traveling position at which the coupling collet connects a large size section of a tool train with a small size section and a second release position at which the small size tool train section is released from the parking tool. The housing includes a parking collet operated by movement of the coupling collet for releasably locking the parking tool in the landing nipple when the coupling collet moves to a release position. The landing nipple is a dual wall flow conductor having an inner parking tube including a stop shoulder and a locking recess and fluid bypass ports longitudinally spaced on either side of the parking position of the parking tool and an outer housing defining an annular bypass flow passage between the ports.

10 Claims, 14 Drawing Figures

LANDING NIPPLE FOR PUMPDOWN WELL COMPLETION SYSTEM

This invention relates to oil and gas well completion systems equipped for remote well servicing by pumpdown techniques and more specifically relates to a landing nipple for a parking tool used in a pumpdown well completion system.

Oil and gas wells are frequently drilled at remote locations along ocean, lake, and river bottoms where well servicing is difficult, time consuming, and expensive. One particular system of technology which has developed to provide hydraulic well servicing of such remotely located wells is a through-the-flowline pumpdown well completion system in which well servicing tools are pumped to and from remotely located wells in the flowlines in which the wells are produced from servicing facilities located on platforms or at shore bases. Pumpdown well completion systems of the type to which the invention relates are illustrated, for example, at Pages 4069–4080 of the 1974–75 edition of COMPOSITE CATALOG OF OIL FIELD EQUIPMENT AND SERVICES, published by World Oil, Houston, Texas, and in U.S. Pat. No. 3,542,125 issued to Philip S. Sizer on Nov. 24, 1970.

In some instances remote underwater wellheads may be located several miles from service facility bases and extension of the relatively small tubing sizes often used in wells to such bases involves excessive friction and pressure losses when flowing wells and when pumping tools to and from the wellheads in small tubing. Under such circumstances, it is desirable to use a substantially larger tubing for the flowlines running between the service facilities and the wellheads while the substantially smaller tubing is employed in the wells. For example, where wells are completed with two-inch tubing and the wellheads are great distances from the service facilities, it is preferred that the flowlines leading to the wellheads from the service facilities be made of four inch tubing. It will be apparent that when using tubing of different sizes for a flowline, the piston units or locomotives used for pumping the well tools to and from a wellhead cannot be used in both the larger and the smaller flowlines. Obviously, the four inch size piston units cannot enter the two inch size tubing and a two inch size piston unit is too small to form a seal with the wall of the tubing so that it cannot be pumped along the four inch flowline. Thus, in order to make the larger and smaller tubing sizes compatible in a single pumpdown system, it has been necessary to develop pumpdown tool strings including piston units which are pumpable in both the large and smaller portions of the flowline. Accordingly, there has been developed a system for handling a single tool string having the portion carrying the tools for servicing the well coupled with small piston units and the portion which is pumped in the larger tubing equipped with larger piston units while the two sections of the tool train are connected together by a parking tool which lands and locks at a landing nipple located at the transition between the larger and smaller tubing sizes along the flowline. The larger section of the tool string remains at the end of the larger tubing while the smaller section of the tool string is released for continuing into the well bore for servicing the well. The parking tool and the piston units connected thereto cause a substantial pressure drop in the flowline at the landing nipple which impairs pumping the released small size tool train section along the small size flowline. Also the pressure drop tends to pump the parking tool and large size piston units back out of the landing nipple during reverse flow. Thus, a new landing nipple allowing bypass flow became a necessity for a parking tool.

It is a particularly important object of the invention to provide a new and improved landing nipple for use in pumpdown completion systems in oil and gas wells. It is another object of the invention to provide a landing nipple for pumpdown well completion systems which permits the operation of a pumpdown tool train having one section which includes piston units of a first larger size and another section arranged in tandem which includes piston units of a smaller size so that the larger size piston units are used to pump the tool train through the portion of a flowline formed of larger tubing while the section of the tubing string having the smaller size piston units is released from and relatched with the section having the larger size units for servicing the smaller size tubing of the flowline leading into the well bore.

In accordance with a further object of the invention, a pumpdown tool train having one section of larger size piston units and a second section of smaller size piston units includes a landing nipple for a pumpdown parking tool which allows fluid bypass around the parking tool and piston units so that no pressure drop occurs as the fluid passes the parking tool and piston units.

In accordance with the invention there is provided a landing nipple for use in a pumpdown well completion system having two different size flowlines between a service station and a wellhead. The landing nipple has a first end coupling for connection with a large size flowline, a second end coupling for connection with a small size flowline, a tubular housing connecting the couplings, a parking tube concentrically spaced within the housing defining an annular bypass flow passage between the housing and parking tube, an internal parking tool landing and locking recess profile along the parking tube, and flow ports in the parking tube on opposite sides of the landing and locking recess profile. The parking tube also includes a reduced bore portion between the landing and locking recess profile and the coupling for connecting the nipple to the small size flowline. The landing nipple permits operation of tool trains having piston units of different diameters allowing the landing and locking of the section of the train having the larger diameter units at the landing nipple located at the transition between the two sizes of tubing strings while the section of the tool train having the smaller units is released and pumped into the smaller flowline in the well for servicing the well. Hydraulic fluid used for pumping the tool train bypasses the parking tool and large size piston units along the landing nipple bypass flow passage. When well servicing is completed, the smaller section of the tool train is returned to the landing nipple at the transition between the tubing strings, recoupled with the larger section of the tool train by means of the parking tool, and the complete tool train is secured to the service facility in the larger size section of the flowline.

The invention and its objects and advantages will be better understood from the following detailed description of a preferred embodiment thereof taken in conjunction with the accompanying drawings wherein:

FIG. 1 is a schematic view in section and elevation of an underwater wellhead in a pumpdown well completion system connected with a flowline including sections of different sizes showing a parking tool, a landing nipple according to the invention at the location of tube size change, and a tool train formed of two sizes of piston units and including a parking tool landed and locked in the landing nipple;

Figure 7:
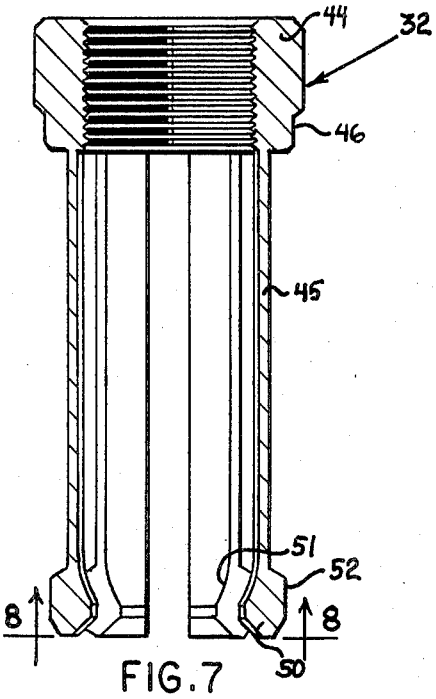
Figure 8:
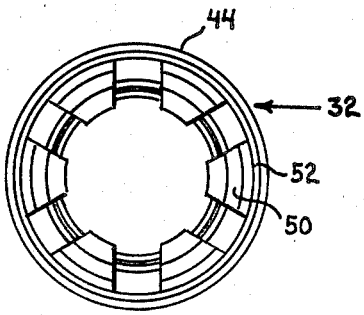
Figure 4A:
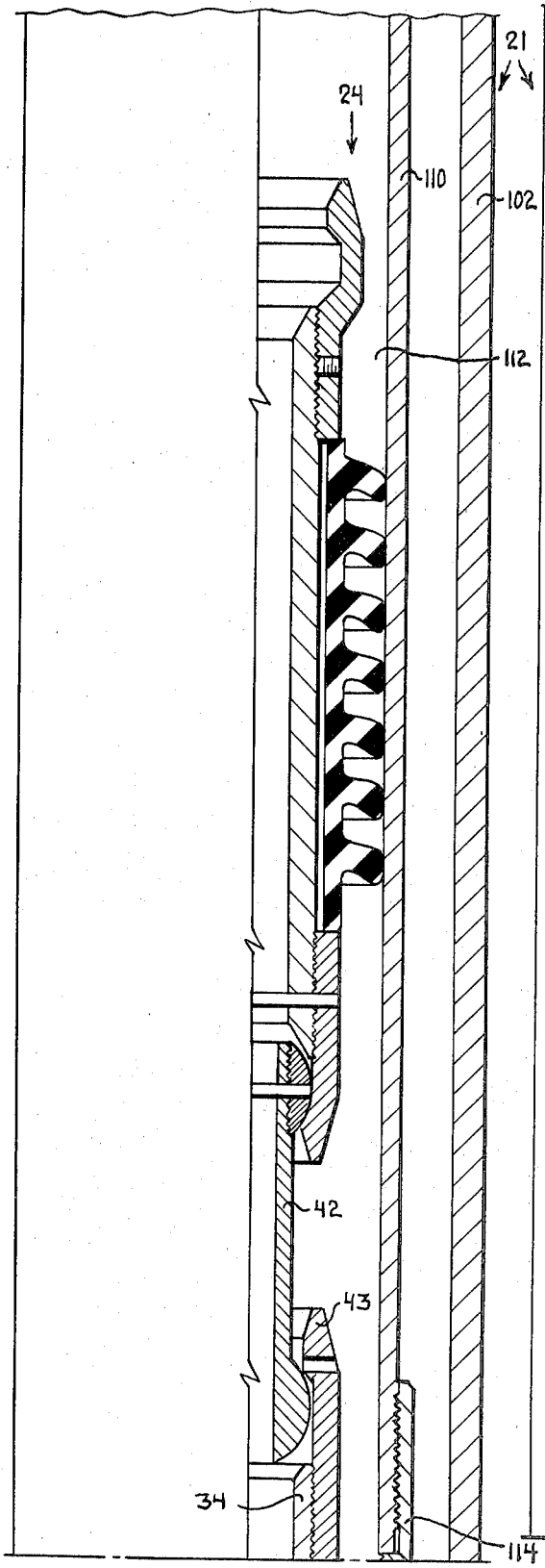
Figure 4B:
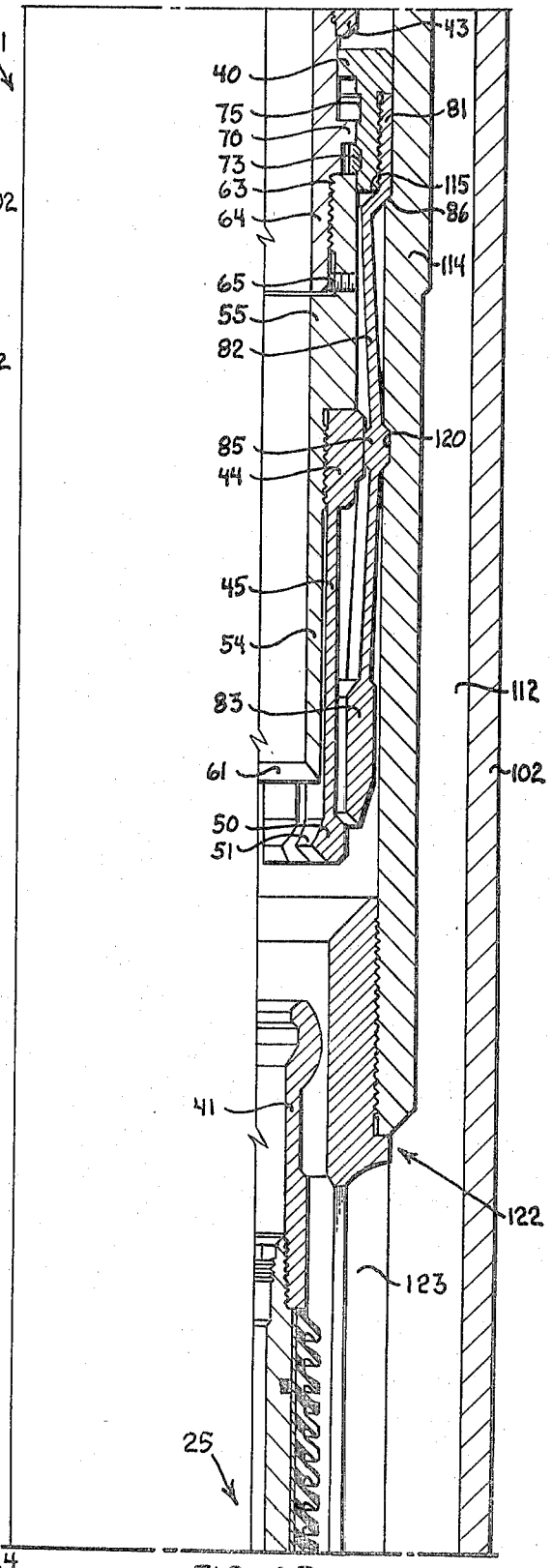
Figure 4C:
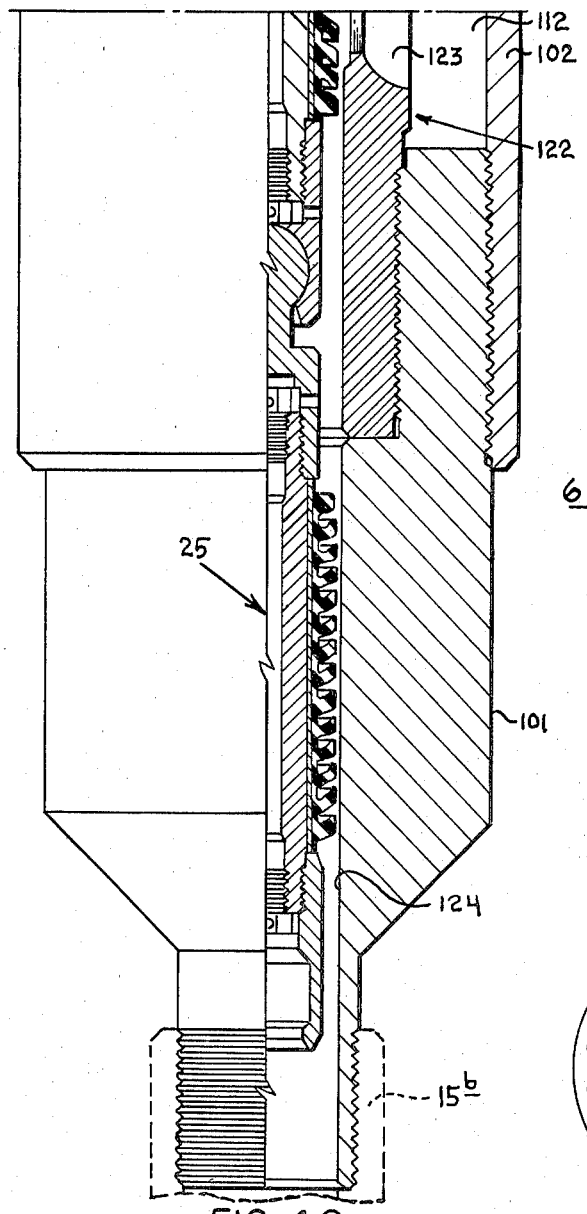
Figure 5:
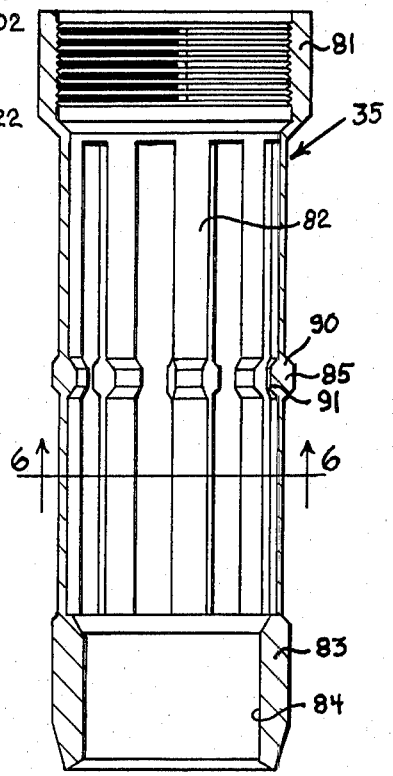
Figure 6:
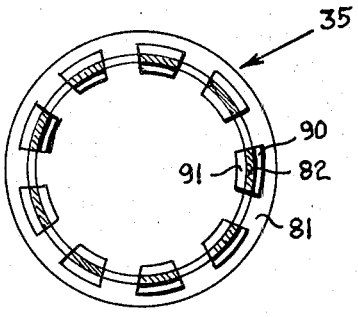

FIGS. 3A, 3B, 3C, and 3D taken together form a longitudinal view in section and elevation of a pumpdown tool train including the parking tool and a section of flowline including the landing nipple of the invention shortly before landing and locking of the parking tool in the landing nipple at the transition between tubing sizes;

FIGS. 4A, 4B and 4C form a longitudinal view in section and elevation showing the parking tool landed and locked in the landing nipple and the small size section of the tool train released and moving into the small tubing size of the flowline;

FIG. 5 is a longitudinal view in section and elevation of the locking collet member of the parking tool housing;

FIG. 6 is a view in section along the line 6—6 of FIG. 5 illustrating the locking collet fingers and locking bosses on the collet fingers;

FIG. 7 is a longitudinal view in section and elevation of the coupling collet on the mandrel of the parking tool for connecting the smaller tool train with the parking tool; and FIG. 8 is a lower end view of the coupling collet of FIG. 7.

Figure 1:
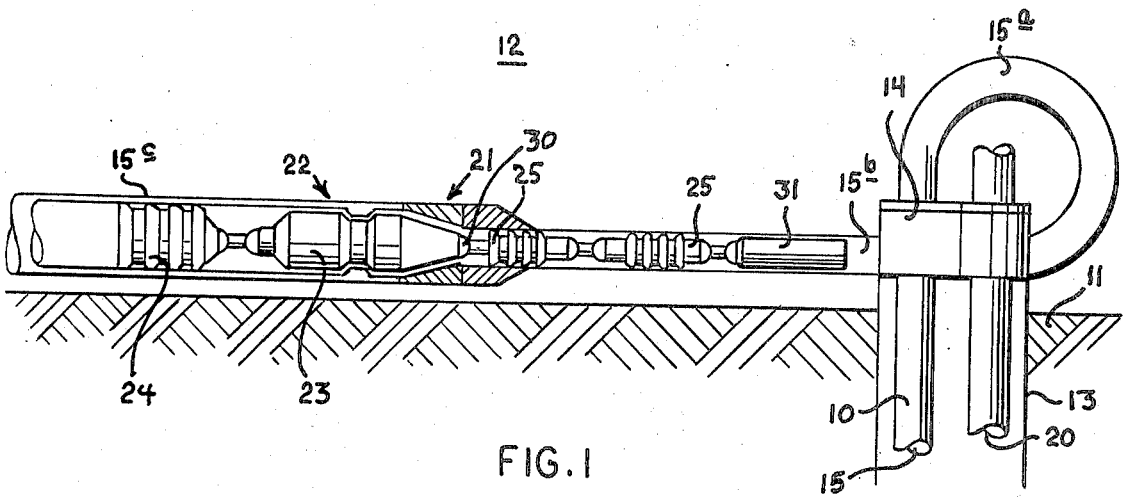
FIG. 1A is a view similar to FIG. 1 showing the smaller size section of the pumpdown tool train released from the larger section by means of the parking tool.

Referring to FIG. 1 of the drawings, a well 10 is drilled into the floor of a body of water 12 which may be a river, a lake, or a portion of the ocean. The well is equipped with a casing 13 which supports a wellhead 14 through which a pair of tubing strings 15 and 20 are connected into the well for producing and servicing the well. Both of the tubing strings form flowlines which extend along the bottom to a service facility, not shown, which may be located on a platform above the water or at a shore base. The flowline 15 has a loop entry portion **15*a* which connects the vertical and horizontal portions of the flowline and is formed on a radius sized to permit movement of the pumpdown tool train into and out of the section of the flowline in the well. The flowline 15 has a horizontal small size section 15*b* which connects into a parking tool landing nipple embodying the features of the invention connected with a large size section of the flowline 15*c* extending along the bottom to the service facility. The section of the flowline 15 in the well and the sections 15*a* and 15*b* of the flowline are smaller tubing while the section 15*c* extending to the service facility from the landing nipple 21 is larger size tubing. Typically, the tubing connected from the landing nipple through the wellhead into the well may be a two-inch tubing while the larger tubing extending to the service facility from the landing nipple may be four-inch tubing. FIG. 1 illustrates a pumpdown tool train 22 landed and locked in the flowline at the landing nipple 21. As illustrated, the tool train comprises a parking tool 23 coupled with a large pumpdown piston 24 sized to fit the large section of the flowline from the service facility to the landing nipple 21 and a small tool train section including a small piston unit 25, a pumpdown jar 30 and a safety valve and locking mandrel 32 which are sized to fit the smaller portion of the flowline along the sections 15*b*, 15*a*, and extending down in the well 10. The complete tool train including the large and small pistons along with the well tools is pumped coupled together as a unit through the larger portion 15*c* of the flowline into the landing nipple 21. At the landing nipple the parking tool 23 operates to release the smaller section of the tool train which then is pumped along the flowline sections 15*b* and 15*a* into the flowline within the well 10. When the well has been serviced by means of the small tool train section such as by landing and locking the safety valve and the lock mandrel 31 at a landing nipple, not shown, down in the well along the tubing string 15, the small piston unit 25 and the well tools coupled with the unit are returned back up through the flowline into the landing nipple 21 where the returning small tool train section is reconnected with the parking tool 23 and the large and small sections of the tool train recoupled together are returned as a unit back along the large flowline portion 15*c*** to the service facility. The particular tool illustrated as components of the tool train are only given by way of example. Any combination of a substantial number of tools and piston units may be included in the tool train. For example, several large and several small piston units may be required to perform the necessary locomotive service. Both hydraulically operated jars and mechanical jars may be used. Various types of valves, plug chokes, connecting joints between the tools, paraffin cutters, sand washing noses, and other well servicing tools may be included in the small portion of the tool train pumped into a well for well servicing depending upon the well servicing requirements of the particular well.

Figure 2:
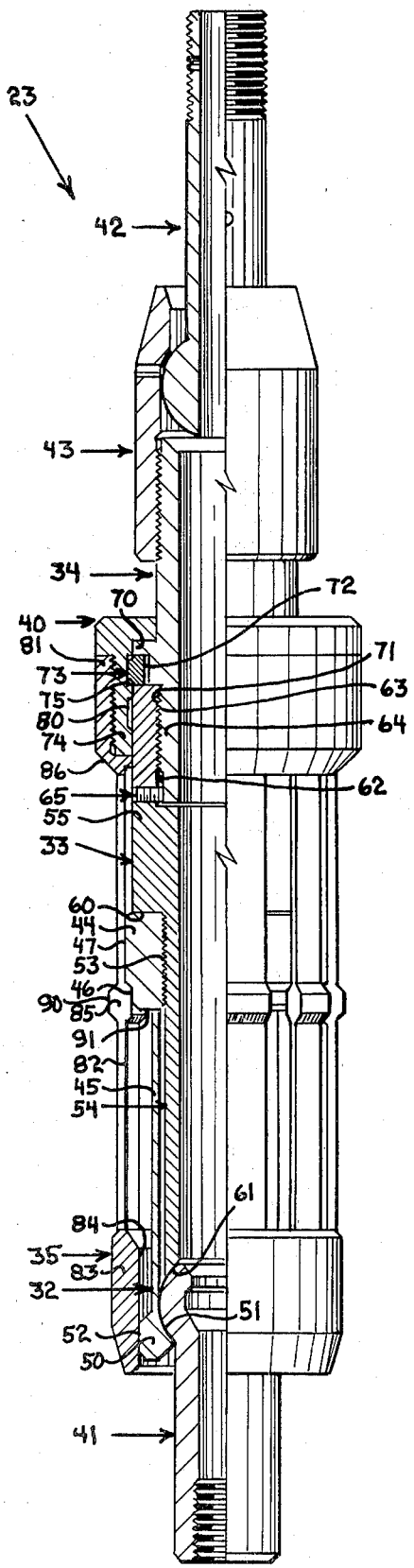
FIG. 2 is a longitudinal view partly in section and elevation of the parking tool.

FIG. 2 illustrates the structural details of the parking tool 23 which is also disclosed and is claimed in U.S. Application Ser. No. 228,894, filed Jan. 27, 1981. The tool has a tubular mandrel which telescopes within an outer tubular housing. The central tubular mandrel includes a coupling collet 32 secured on a tubular body 33 which is secured with a tubular body connector 34. The outer housing is formed by a locking or parking collet 35 and an annular retaining cap 40. The parking tool is releasably coupled with the small section of the tool train by a fish neck ball connector 41 which is releasably coupled with the tool by the coupling collet 32. The parking tool is connectible with the large section of the tool train by a ball connector 42 held on a threaded end portion of the body connector 34 by a swivel connector 43.

Referring to FIGS. 2 and 7, the coupling collect 32 is an integral member having an internally threaded annular body 44 and circumferentially spaced collet fingers 45 connected along one end with the body and provided along the opposite end with locking heads 50. Each of the locking heads 50 has an internal curved surface portion 51 shaped to fit the outer surface of the ball portion of the fish neck ball connector 41 so that when the collet heads are all confined around the ball connector the connector is held firmly while being allowed to swivel to a limited extent allowing the tool train to easily traverse the curved portions of the flowline. The outer surfaces 52 of the collet heads 50 are cylindrical surface portions which serve as locking surfaces when the collet heads are within the end portion of the parking collet 35 which has an internal cylindrical locking surface holding the collet heads 50 around the ball connector 41. The body portion 44 of the coupling collet 32 is threaded on the mandrel body 33 along a threaded section 53 of a reduced tubular portion 54 of the mandrel body. The mandrel body has an enlarged portion 55 provided with an external annular shoulder 60 against which the end face of the coupling collet body 44 fits when the coupling collect is on the mandrel body. The end face 61 of the tube portion 54 of the mandrel body is a curved internal annular surface shaped to fit the surface of the ball on the fish neck ball connector 41 allowing a close fit which permits the ball to freely swivel when coupled with the parking tool during pumping the tool to and from the landing nipple 21. The portion 55 of the mandrel body has a counter bore 62 which is internally threaded at 63 for securing on an externally threaded end portion 64 of the body connector 34. A set screw 65 threaded through the mandrel body portion 55 locks the mandrel body against unscrewing from the body connector 34. The body connector 34 has an external annular flange 70 spaced from the threaded reduced portion 64 so that the end face 71 of the mandrel body portion 55 and the adjacent face of the flange 70 define an external annular recess 72 in which a locking snap ring 73 is fitted for releasably locking the inner mandrel of the parking tool relative to the housing of the tool. The snap ring 73 with an end portion of the mandrel body portion 55 and a portion of the body connector 34 fits in sliding relationship within the retaining cap 40. The retaining cap 40 has a reduced externally threaded portion 74 which threads into an end of the parking collet 35 around the mandrel body portion 55 and the body connector 34. The retaining cap has longitudinally spaced internal annular latching recesses 75 and 80 in which the outer surface of the snap ring 73 is engageable at locking and release positions of the coupling collet 32. As illustrated in FIG. 2, snap ring 73 is engaged in the latching recess 75 holding the coupling collet 32 within the parking collet 35 so that the coupling collet is locked around the ball on the fish neck ball connector 41. When the mandrel of the parking tool is extended to the release position at which the heads 50 of the coupling collet 32 extend beyond the end of the parking collet, the snap ring 73 is engaged in the latching recess 80. The parking collect 35, shown in detail in FIGS. 5 and 6, is an integral member having an enlarged internally threaded head 81, a plurality of longitudinal circumferentially spaced collet fingers 82, and a retaining ring 83. The head 81, as shown in FIG. 2, threads on the portion 74 of the retaining cap 40. The ring 83 has an internal cylindrical locking surface 84 which fits around the coupling collet heads 50 when the coupling collet is withdrawn into the parking collet as shown in FIG. 2 holding the coupling collet heads around the ball on the fish neck ball connector 41. Each of the locking fingers 82 has a locking boss portion 85, each of which has an outer boss 90 which interlocks the parking tool with the landing nipple 21 and an inner locking boss 91 which is engageable by the outer side surface of the head 44 of the coupling collet for radially expanding the collet fingers 82 to locking positions. The body 44 of the coupling collet 32 has a reduced lower end portion providing an external annular recess 46 which permits the inner locking bosses 91 on the collet fingers 82 to fit closely around the coupling collet body when the collet fingers 82 are in the normal retracted relaxed condition during the periods when the tool train is being pumped to and from the landing nipple 21.

For operation of a tool train including the parking tool 22, it is necessary that a landing nipple be provided at the transition between the large and small sections of the flowline. FIGS. 3A–3D, inclusive, show the landing nipple 21 constructed in accordance with the invention which is schematically illustrated in FIGS. 1 and 2 connecting the large flowline section 15*c* with the small flowline section 15*b*. The parking tool landing nipple 21 has a first end coupling 100 sized to connect with the large flowline section 15*a* and a second opposite end coupling 101 sized to connect into the small flowline section 15*b*. The end couplings are connected together in spaced relation by a tubular housing 102 which is internally threaded at opposite ends for connection with the couplings. The first end coupling 100, FIG. 3A, has a reduced externally threaded end portion 103 which threads into an end of the large flowline section 15*c* and a larger externally threaded end portion 104 which threads into an end of the housing 102. The bore 105 through the coupling 100 is sized to match the bore in the flowline section 15*c* so that the large section of the tool train may move from the flowline section 15*c* through the coupling 100 without a change of diameter. A parking tube 110 is fitted in internal concentric spaced relation within the housing 102. One end of the parking tube fits into a counter bore 111 in the coupling 100 so that the bore of the parking tube is sized to match the bore 105 through the coupling 100. The concentric spacing of the parking tube and the housing 100 provides an annular bypass flow passage 112 between the outer surface of the parking tube and the inner wall of the housing. The upper end portion of the parking tube is provided with a plurality of longitudinal circumferentially spaced flow ports or slots 113 which communicates the bore of the parking tube with the bypass flow passage 112. The other end of the parking tube is threaded into an end of a parking nipple 114 which has an internal annular recess configuration shaped for landing and locking the parking tool in the parking nipple. The parking nipple has a no-go internal annular shoulder 115 facing the entrance end of the nipple which is the end connected with the parking tube 110. Spaced from the no-go shoulder in a direction away from the entrance end of the landing nipple, the nipple has an internal annular locking recess 120. The no-go shoulder 115 is sloped to support the landing shoulder 86 on the parking collet head 81. The locking recess 120 is spaced from the no-go shoulder 115 to receive the locking bosses 90 on the locking sections 85 of the collet fingers 82 on the parking collet. The end portion 121 of the parking nipple 114, opposite the entrance end, is threaded on one end of a bypass return nipple 122 the opposite end of which is threaded into the coupling 101. The bypass return nipple is concentrically spaced within the housing 102 to define between the nipple and the housing the return end of the annular bypass passage 112. The bypass return nipple has a plurality of longitudinal circumferentially spaced return slots or ports 123 which permit fluid to flow back into the central bore of the nipple 21 from the annular bypass passage 112. The bore through the bypass return nipple and the bore 124 through the coupling 101 are of the same size as the bore through the small flowline section 15*b* sized for the seal members on the small pumpdown pistons 25. The longitudinal positions of the various structural features of the landing nipple 21 are determined by the distances along a pumpdown tool train between the parking tool and the large and small pumpdown pistons. The landing nipple supports the large pumpdown pistons and the parking tool while the released small pistons and well servicing tools are pumped into and returned from the well. Thus, with the parking tool landed and locked along the parking nipple 114 the large pumpdown pistons 24 must be located within the parking tube 110 downstream from the ports 113. The landing nipple must be long enough to house the longest large size section of a tool train between the ports 113 and the parking nipple 114. Similarly, at least one of the small pumpdown pistons 25 must be located downstream from the ports 123 so that when the small section of the tool train is released from the large section fluid will flow from the bypass passage 112 into the central bore of the landing nipple upstream from or behind at least one of the small pistons to displace the small tool train section after release into the small flowline section 15*b*.

Figure 1A:
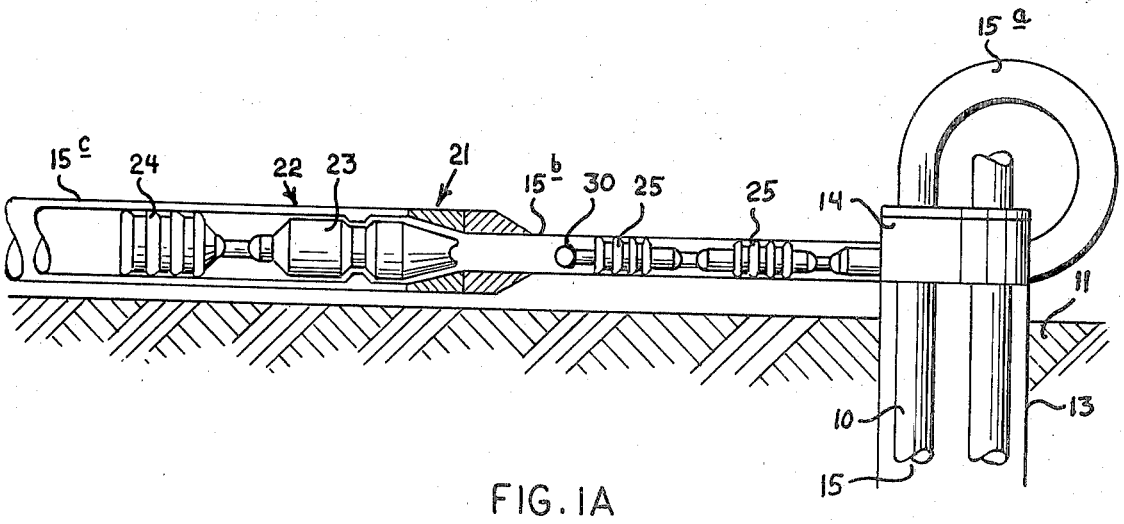
Figure 3A:
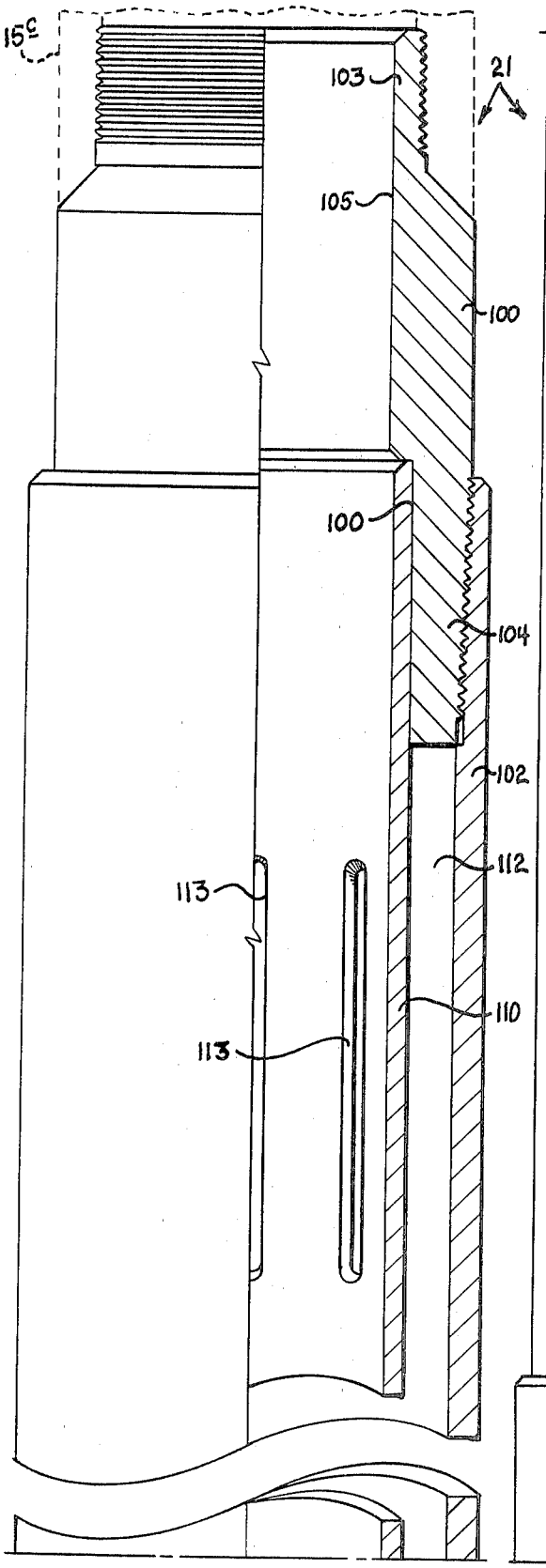
Figure 3B:
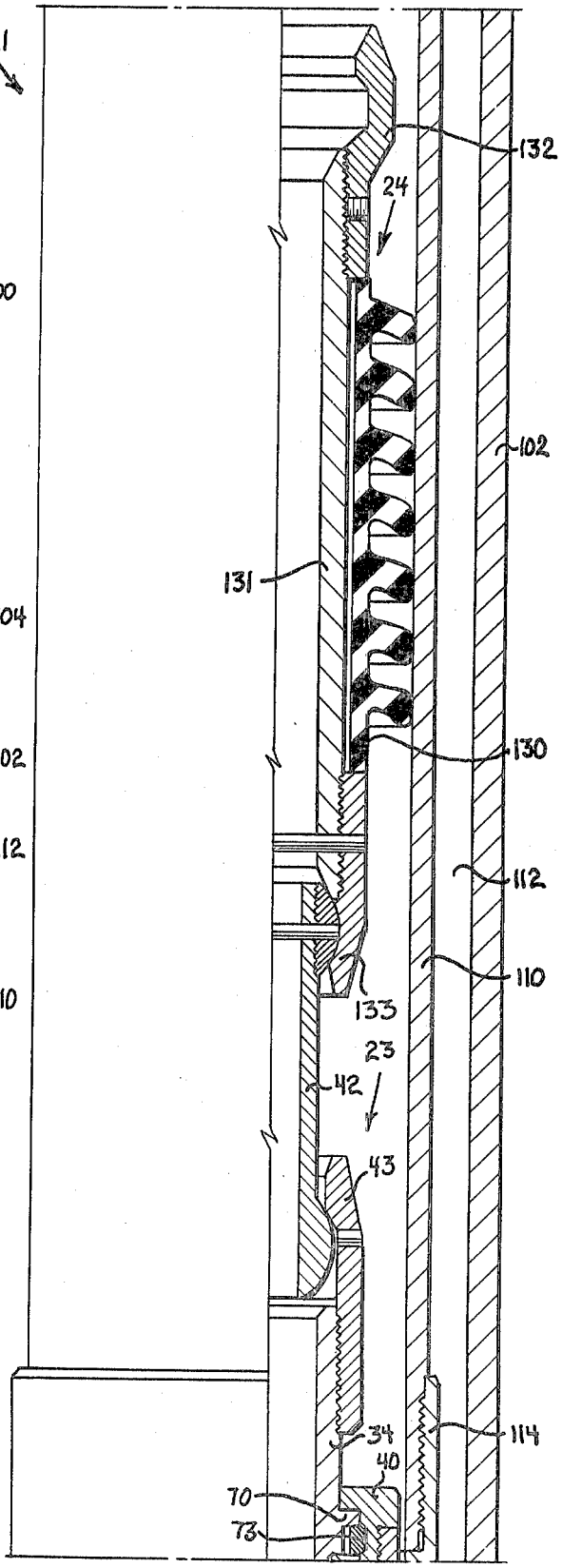
Figures 3C, 3D:
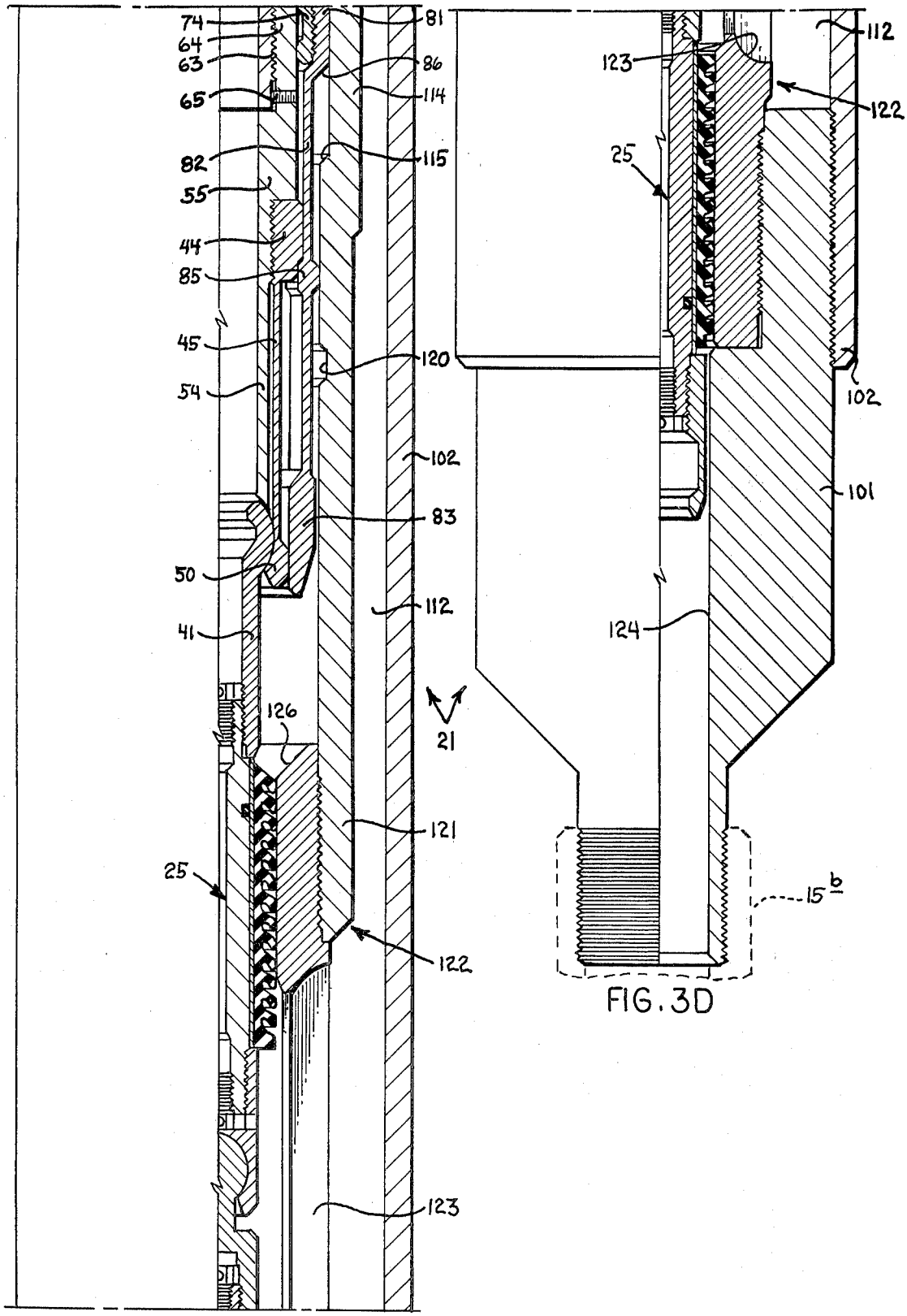

In operation, the parking tool 23 is used as the coupling between the large size portion of the tool train 22 and the small size portion of the tool train. A suitable number of the large piston units 24 for moving the tool train in the large flowline section and a suitable number of the small pistons 24 for moving the small tool train portion in the small flowline sections are selected and coupled together in the tool train with the parking tool and such other well tools as may be required for servicing a well. For purposes of simplicity of description, the detailed FIGS. 3A–3D and FIGS. 4A–4C show only one of the large pistons and two of the small pistons. The valve, jars, and other well servicing tools which would form a part of the small size tool train portion are not shown except diagrammatically in FIGS. 1 and 1A. Typical pumpdown pistons which may be employed are illustrated and described at Page 4080 of COMPOSITE CATALOG OF OIL FIELD EQUIPMENT AND SERVICES, supra. Typically, a pumpdown piston unit, as shown in FIG. 3B, comprises an annular multi-finned seal element 130 mounted on a tubular mandrel 131. The opposite ends of the mandrel may be fitted with ball couplers 132 and 133 as illustrated. The fins on the seal element form a sliding seal with the inner wall of the flowline so that a pressure differential is imposed across the seal elements so that the piston units may be pumped along the flowline for transporting well tools connected with the unit. The construction of the large piston units 24 and the small piston units 25 is substantially identical.

Referring to FIGS. 1 and 3A–3D, showing the pumpdown pistons and the parking tool 23 only of the tool train 22, the tool train is inserted into the large size portion 15*c* of the flowline at the service facility, not shown, and pumped along the flowline into the landing nipple 21. The tool train is shown in FIGS. 3A–3D entering the landing nipple prior to landing and locking in the nipple. As also represented in FIG. 2, the parking tool mandrel including the coupling collet 32 is at the retracted position within the tool housing at which the fish neck ball connector 41 is locked with the tool by the collet heads 50. The snap ring 73 is releasably engaged in the locking recess 75 of the retaining cap 40. The parking collet fingers 82 are in normal straight relaxed positions with the portions 85 resting in the recess 46 of the coupling head 44. The coupling collet heads 50 are retracted into the parking collet ring 83 with the collet head surfaces 52 engaged with the ring locking surface 84. Thus the collet heads 50 are held around the fish neck ball connector 41 at the positions illustrated at which the curved inner surfaces 51 of the collet heads 50 are held along the surfaces of the ball of the connector holding the ball connector in coupled relationship with the parking tool. Of course, the ball connector 42 at the other end of the parking tool is connected with the large size portion of the tool train while the ball connector 41 couples the small size portion of the train with the parking tool.

As the tool train 22 is pumped into the landing nipple 21, the downwardly and inwardly tapered upper end surface 126 in the landing nipple bypass return member 122 directs the small size portion of the tool train into the small size section of the flowline 15*b*. At the particular position of the tool train illustrated in FIGS. 3C and 3D the small pumpdown pistons 25 are in the small diameter portion of the landing nipple as the shoulder 86 on the parking collet of the parking tool approaches the no-go shoulder 115 in the landing nipple 21, FIG. 3C. Referring to FIGS. 4A and 4B, the shoulder 86 on the parking tool lands on the no-go shoulder 115 in the landing nipple 21. The forward movement of the tool train is stopped at this point. Continued pumping applies a pressure along the bypass nipple passage 112 behind the small pistons which are forced down pulling the parking tool mandrel down tending to move the mandrel relative to the parking collet 35. At this point the snap ring 73 restrains the mandrel against relative movement within the parking collet. The forward force, however, causes adjacent sloping surfaces on the snap ring and along the recess 75 to cam the snap ring inwardly releasing the parking tool mandrel for forward movement. The mandrel moves relative to the parking collet 35 until the snap ring has been compressed inwardly and expanded radially into the recess 80 of the retaining cap 40. At this relative position of the parking tool mandrel within the parking collet the coupling collet heads 50 are extended beyond the parking collet ring 83 as shown in FIG. 4B releasing the collet heads 50 to expand radially which releases the ball of the connector 41 as also shown in FIG. 4B so that the small section of the tool train including the small piston units 25 is released to continue movement along the small flowline section 15*b*. At the same time that the coupling collet heads 50 are extended beyond the parking collet ring 83, the coupling collet head 44 by coengagement of the sloping surfaces on the head 44 and the sloping surfaces along the inside faces of the parking collet bosses 91 expands the parking collet fingers 82 until the outer cylindrical surface 47 of the coupling collet head 44 is within the inside surfaces of the locking portions 85 of the collet fingers 82. The locking bosses 90 on the locking portions 85 of the collet fingers 82 are expanded into the internal annular locking recess 120 of the landing nipple 21 locking the parking tool in the landing nipple thereby parking the large size portion of the tool train at the landing nipple while the small size portion of the train is released to advance into the well through the small size section of the flowline 15. The engagement of the snap ring 73 in the locking recess 80 of the retaining ring 40 of the parking tool holds the parking tool mandrel at the locking position shown in FIG. 4B until a sufficient force is applied to the parking tool mandrel back toward the large pumpdown piston 24 at the time of recoupling the small section of the tool train with the large section for return to the service facility.

It will be recognized that the hydraulic fluid used for pumping the tool train along the flowline will flow through the large piston units 24 and the parking tool since there is an open bore the full length of such components. A problem is presented, however, in pumping fluid through the parked tool train if the fluid is confined to the bore in which the train is parked due to substantial frictional losses causing pressure drops and due to possible damage to the piston elements as the fluid is pumped past. Thus, in accordance with the invention, the landing nipple 21 is especially designed to alleviate the pressure drop problem by diverting the pumped fluids around the large size pumpdown tool train section. Referring to FIGS. 3A–3D, the fluid flows from the central bore of the landing nipple outwardly through the ports 113 upstream from the parked large size tool train section into the annular bypass flow passage 112. The fluid bypasses the parked tool train section along the passage 112 re-entering the central bore of the landing nipple in the bypass ports 123 so that the pumped fluid applies a downward pressure to the small piston unit 25 below the ports 123 for pumping the small tool train section into the small size flowline section **15*b*, through the loop 15*a*, and downwardly in the tubing string 15 in the well 10. The small size tool train section is manipulated in the well tubing string 15 until the particular service mission is accomplished which may be, for example, the landing and locking of a safety valve. It will be recognized that during the pumping of the tool train 22 to the landing nipple 21 and the further pumping of the small tool train section into the well tubing string 15, there is fluid return back to the service facility through the flowline 20 which extends around a loop configuration and back to the service facility along the same route followed by the flowline 15**. The pumped fluid crosses over between the tubing strings in the well bore through standard pumpdown pipe connections, not shown.

After completion of the pumpdown well servicing mission, the direction of hydraulic fluid flow in the flowlines 15 and 20 is reversed with fluid being pumped from the service facility through the flowline 20 and returned through the flowline 15. The reverse flow pumps the small tool train section back to the surface of the flowline 15 until the small tool train section passes through the flowline section **15*b* re-entering the landing nipple 21. During the return flow of the hydraulic fluid the fluid bypasses the parked large tool train section along the bypass flow passage 112** as previously described. This prevents a substantial pressure drop across the parked large tool train section which might tend to unlock the parking tool.

As the returning small tool train section re-enters the landing nipple 21, the parking tool 23 is locked in the landing nipple as shown in FIG. 4B. The ball on the connector 41 is reinserted into the coupling collet 32 within the collet heads 50. The upward force on the coupling collet urges the collet upwardly relative to the parking collet 35 forcing the snap ring 73 to compress inwardly releasing the coupling collet so that the parking tool mandrel is driven upwarldy back to the running position of FIGS. 2, and 3C. When the coupling collet heads 50 re-enter the parking collet ring 83, the collet heads 50 are compressed around the ball on the connector 41 recoupling the small tool train section with the parking tool. The upward movement of the parking tool mandrel moves the coupling collet head 44 above the parking collet locking finger sections 85 so that the parking collet fingers 82 contact inwardly releasing the locking bosses 90 on the collet fingers 82 from the locking recess 120 in the landing nipple 21 so that the parking tool is free to move upwardly from the landing nipple. At the upper end position of the parking tool mandrel the snap ring 73 springs back outwardly into the locking recess 75 releasably locking the mandrel in an unlocked traveling position. With the small size tool train section recoupled with the large size section, the tool train 22 is pumped back to the service facility.

While only the flowline 15 has been described and illustrated as including the parking tool nipple 21, it is to be understood that the flowline 20 may also be similarly equipped so that pumpdown well completion servicing may be carried out in the flowline 20 using the large size tool train to transport the tools to the wellhead and the small size tool train for the actual servicing in the small tubing string in the well. Further, while the parking tool landing nipple 21 has been illustrated in the horizontal portion of the flowline near the wellhead, it is to be understood that the transition between the large size and small size flowlines may occur within the well bore under circumstances where there is a flowline size change within the well. Some wells contain tapered tubing strings which are formed by the interconnection of tubing string sections of different sizes. For example, a large size tubing string may extend to a certain depth within a well beyond which a smaller size tubing string will be used. At the transition between sizes the parking tool landing nipple may be connected between the tool string sections to permit pumpdown operations using a tool string having different size sections as previously described. While it will present a more complex wellhead, it is possible to place the parking tool landing nipple in the wellhead where a flowline of one size is extended to the wellhead with a smaller size tubing string being used within the well. Under any of these different situations the landing nipple will be constructed with the same features as illustrated and described herein.

It will now be recognized that a new and improved landing nipple for a parking tool in a pumpdown well completion system has been described and illustrated which permits using a large flowline for pumping a tool train to a location near or in a well and thereafter pumping a small size separable tool train section into a small tubing string within the well. The landing nipple provides a fluid bypass around the large size parked tool train section so that adequate pressure is available to continue pumping the small size tool train section beyond the landing nipple. During reverse flow when the small size tool train section is returned to the landing nipple, the bypass flow passage of the nipple prevents a large pressure drop across the large size tool train section which would tend to release and pump the parking tool and large size piston units back out of the landing nipple before recoupling with the small size tool train section.

What is claimed is:

1. A landing nipple for a pumpdown well servicing system parking tool comprising: a first end coupling for connection with a large size flowline; a second opposite end coupling for connection with a small size flowline; a tubular housing secured at opposite ends with said first and second end couplings; and a parking tube secured between said couplings in concentric spaced relation within said housing defining with said housing an annular bypass flow passage within said housing around said parking tube, said parking tube having an internal landing and locking recess profile for releasable locking said parking tool in said parking tube, and said parking tube having longitudinally spaced ports for fluid flow between the bore of said parking tube and said annular flow passage upstream and downstream of a parking tool and large piston unit means locked in said parking tube.

2. A landing nipple in accordance with claim 1 where said landing and locking recess profile comprise an annular no-go shoulder and an annular locking dog recess.

3. A landing nipple in accordance with claim 2 where said parking tube has a bore sized for said large piston unit on one side of said landing and locking profile and a bore sized for said small piston unit on the other side of said profile.

4. A landing nipple in accordance with claim 3 where said parking tube is formed of a first tube section having said large size bore, a second tube section having said landing and locking profile and a third tube section having said small size bore.

5. A landing nipple in accordance with claim 4 where a first of said parts is in said first tube section and a second of said ports is in said third tube section.

6. A landing nipple in accordance with claim 5 where said parts comprise a plurality of longitudinal circumferentially spaced ports.

7. A landing nipple for supporting a parking tool at a transition location between large and small size flowlines in a pumpdown well completion servicing system comprising: a first tubular pipe coupling having one externally threaded end portion for securing with a large flowline section and an opposite larger externally threaded end portion, said coupling having an internal bore substantially equal to the bore of said large flowline; a second pipe coupling having one externally threaded end portion for securing with a small flowline section and an externally threaded opposite end portion substantially equal in diameter to said larger threaded end portion of said first pipe coupling; a tubular housing connecting said large externally threaded end portions of said first and second pipe couplings in longitudinal spaced relation; a parking tube positioned in concentric spaced relation within said housing connected along one end into said larger end portion of said first pipe coupling and having an internal diameter substantially equal to said bore through said first pipe coupling; a parking tool landing and locking tube section having an internal annular landing and locking recess profile connected along one end into the opposite end of said parking tube having a longitudinal axis coincident with the axis of said parking tube for landing and locking said parking tube while large size pumpdown piston unit means are coupled with said parking tool and located along said parking tube; a tubular connector connected between the second opposite end of said landing and locking tube section and said second pipe coupling along an axis coincident with the axis of said parking tube and said landing and locking tube section, said tubular connector having an internal bore substantially equal to said bore through said second pipe coupling and said small flowline section; the inner wall of said housing and the outer wall of said parking tube, said landing and locking tube section, and said tubular connector defining an annular bypass flow passage along said landing nipple between said first and second pipe couplings; means defining a flow port in said parking tube at a first end of said bypass flow passage and means defining a flow port in said tubular connector at the opposite end of said annular bypass flow passage, said flow ports being longitudinally spaced beyond said parking tool and large size piston unit means connected with said parking tool when said parking tool and said large size piston units are parked and locked in said landing nipple.

8. A landing nipple in accordance with claim 7 wherein said landing and locking profile comprises an internal annular stop shoulder and a longitudinally spaced internal annular locking recess, said locking recess being between said stop shoulder and said second pipe coupling.

9. A landing nipple in accordance with claim 8 wherein said longitudinally spaced port means each comprise longitudinal circumferentially spaced ports.

10. A landing nipple in accordance with claim 9 wherein said tubular connector has an internal annular sloping guide shoulder between said flow ports in said connector and said internal annular locking recess in said landing and locking tube section.

* * * * *